United States Patent [19]

Saunders

[11] 4,445,621

[45] May 1, 1984

[54] EASY-OPEN CONTAINER WALL

[75] Inventor: William T. Saunders, Weirton, W. Va.

[73] Assignee: Stoffel Technologies, Inc., Tuckahoe, N.Y.

[21] Appl. No.: 479,160

[22] Filed: Mar. 28, 1983

[51] Int. Cl.[3] ..... B65D 17/36; B65D 17/34

[52] U.S. Cl. ..... 220/273

[58] Field of Search ..... 220/269–273

[56] References Cited

U.S. PATENT DOCUMENTS

| | | | |
|---|---|---|---|
| 3,366,270 | 1/1968 | Khoury | 220/273 |
| 3,559,842 | 2/1971 | Rich | 220/273 |
| 3,586,203 | 6/1971 | Powell | 220/273 |
| 3,593,877 | 7/1971 | Khoury | 220/273 |
| 3,715,051 | 2/1973 | Hanke | 220/273 |
| 3,720,349 | 3/1973 | Brown | 220/273 |
| 3,850,124 | 11/1974 | Brown | 113/121 C |
| 3,894,652 | 7/1975 | Brown | 220/270 |
| 4,042,144 | 8/1977 | Henning et al. | 220/273 |

*Primary Examiner*—George T. Hall

*Attorney, Agent, or Firm*—Antonelli, Terry & Wands

[57] ABSTRACT

An improved easy-opening container wall and method of forming the same are disclosed. The easy-open container wall comprises a line of weakness in the container wall defining a tear portion at least partially removable from the container wall, a tab having a line of weakness severing nose end, a lifting end, and a hingedly mounted attaching panel located intermediate the ends for permitting hinged movement of a majority of the tab relative to the attaching panel along a hinge line to bring the nose end into forceable engagement with the container wall to rupture the line of weakness and bend a segment of the tear portion inwardly upon lifting the lifting end of the tab, and the tab is attached to the tear portion at locations on both sides of the hinge line to maintain alignment of the tab on the container wall and to provide improved resistance to pulling or tearing the tab material from the container wall at its attachment to the container wall before the container wall can be opened.

10 Claims, 10 Drawing Figures

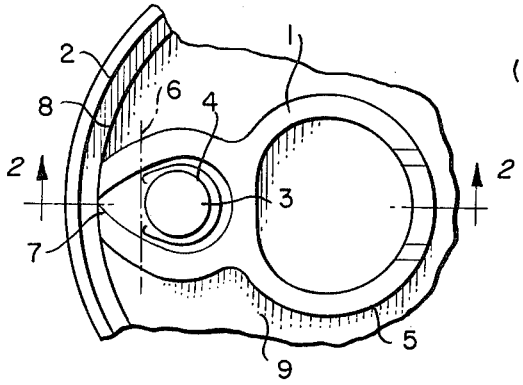
FIG. 1.
(PRIOR ART)
FIG. 2.
(PRIOR ART)
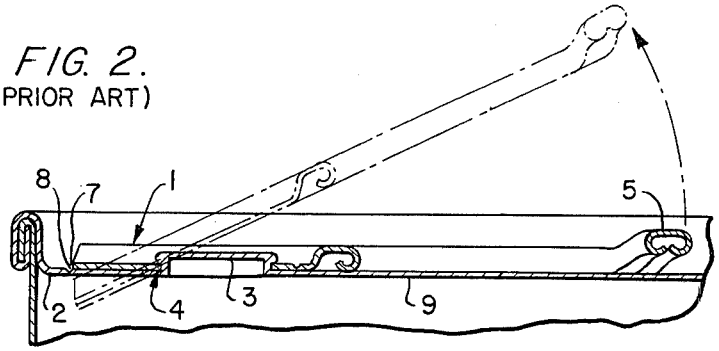
FIG. 3.
(PRIOR ART)
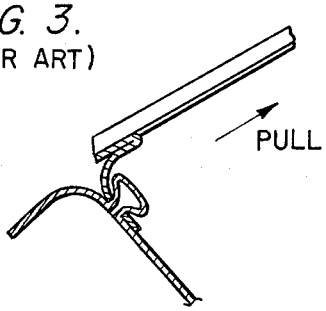
FIG. 4.
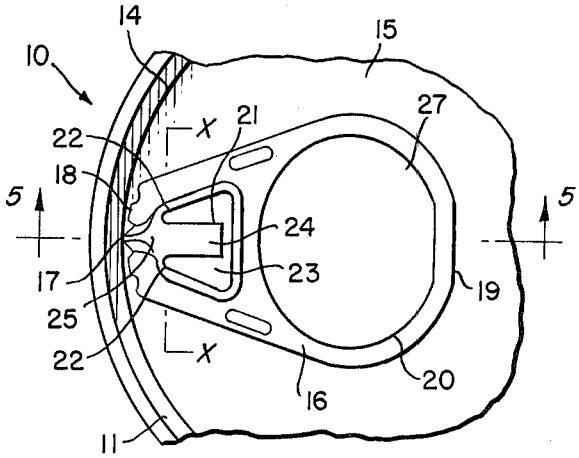

EASY-OPEN CONTAINER WALL

BACKGROUND AND SUMMARY OF THE INVENTION

The present invention relates to an improved easy-open container wall and method of making the same. More particularly, the invention relates to an easy-open container wall comprising a line of weakness in the container wall defining a tear portion at least partially removable from the container wall and a tab connected to the tear portion of the container wall and having a line of weakness severing nose end, a lifting end and hinge means for permitting hinged movement of one portion of the tab relative to another portion along a hinge line to bring the nose end into forceable engagement with the container wall to rupture the line of weakness and bend a segment of the tear portion inwardly upon lifting the lifting end of the tab.

In known commercially-used easy-open structures for containers of the aforementioned type the pull tab is generally secured to the sheet material container wall panel by a rivet head which is press-formed from the sheet material wall panel as in U.S. Pat. No. 3,366,270, for example. FIGS. 1–3 of the drawings illustrate such a known arrangement wherein a pull tab 1 is secured to a sheet material container wall panel 2 by a rivet head 3 which is press-formed from the sheet material wall panel. The rivet head extends through an opening in a hingedly mounted attaching panel 4 of the pull tab located intermediate the ends of the pull tab and extending away from the nose end thereof. The pull tab 1 functions as a lever during opening when the handle end 5 of the pull tab is lifted to pivot the majority of the pull tab relative to the attaching panel about a hinge line 6 to bring the nose end 7 of the pull tab into forceable engagement with the wall panel 2 to rupture a scoreline 8 therein and bend inwardly a segment of a tear portion 9 defined by the scoreline.

One problem associated with this prior art easy-open structure for containers is that when the pull on the pull tab is other than a longitudinal pull, there is a tendency for the pull tab to twist and to tear transversely across the hinge line. The pull tab is also subject to tearing out and structural failure adjacent the rivet head when the pull tab is being lifted upwardly and rearwardly as shown in FIG. 3 to tear the movable wall portion from the container wall panel. Further, this arrangement is problematical in that the pull tab is free to rotate about the rivet head so that it can become misaligned with respect to the scoreline in the container wall panel thereby additionally increasing the likelihood of structural failure of the pull tab at the hinge line or adjacent the rivet head during opening.

There have been numerous attempts in the prior art to avoid or minimize the aforementioned problems with the easy-open container wall of the type illustrated in FIGS. 1–3. For example, in U.S. Pat. No. 3,593,877 it is proposed to provide opposing semicircular slots in the pull tab for receiving a dimple which is formed in the removable panel portion so as to restrain the pull tab against rotation to maintain the nose of the pull tab aligned with the scoreline. However, this additional feature does not guard against twisting or misalignment of the tab which may occur as the handle end of the pull tab is being lifted nor does it aid in preventing tearing out and structural failure of the pull tab about the rivet head as the pull tab is being lifted upwardly and rearwardly during tearing of the removable panel portion from the container wall panel.

In U.S. Pat. No. 3,559,842 a pull tab with hinged attaching panel is disclosed wherein the end portions of a concavely shaped cut defining the attaching panel are reversely turned so as to terminate in a direction opposite from that of the normal tearing stress placed upon the body portion of the pull tab during opening thereby reducing the tendency of the pull tab to twist and tear transversely across the hinge line. However, tearing out and structural failure of the pull tab about the rivet head during opening remains a possibility with this structure.

An object of the present invention is to provide an easy-open container wall of the aforementioned type which avoids the above-discussed problems and disadvantages of the prior art. More particularly, an object of the present invention is to provide an easy-open container wall which is highly resistant to tearing out and structural failure during opening and which will not become misaligned with respect to the line of weakness in the container wall panel.

These and other objects of the present invention are attained by providing an easy-open container wall comprising a line of weakness in the container wall defining a tear portion at least partially removable from the container wall, a tab having a line of weakness severing nose end and a lifting end and having hinge means for permitting hinged movement of one portion of the tab relative to another portion of the tab along a hinge line to bring the nose end into forceable engagement with the container wall to rupture the line of weakness and bend a segment of the tear portion inwardly upon lifting the lifting end of the tab, and attachment means for attaching the tab to the tear portion at locations on both sides of the hinge line.

According to a disclosed, preferred embodiment of the invention the pull tab includes a hingedly mounted attaching panel located intermediate the ends of the pull tab and extending away from the nose end thereof. The attaching panel is an integral part of the tab and is defined by a concavely shaped cut opening towards the nose end of the tab. The pull tab is connected to the tear portion of the container wall by at least one weld connecting the attaching panel of the tab to the tear portion of the container wall panel on the side of the hinge line away from the nose end of the tab and by at least one weld connecting the tab to the tear portion of the container wall panel on the side of the hinge line toward the nose end of the tab. The disclosed preferred embodiment of the method of the invention involves welding the tab to the container wall on both sides of the hinge line by means of a high energy density welding process wherein the energy density is at least $10^6$ watts/inch$^2$ such as with laser welding.

By attaching the tab to the tear portion of the container wall at locations on both sides of the hinge line of the pull tab, the alignment of the tab on the container wall is maintained so that the nose end of the tab remains positioned adjacent the line of weakness in the container wall and at the same time the invention offers the additional significant advantage that during opening the tendency of the tab material to be torn or pulled around its connection with the container wall is avoided since the highly stressed connections experience essentially shear stress during opening.

These and other objects, features and advantages of the present invention will become more apparent from the following description when taken in connection with the accompanying drawings which show, for purposes of illustration only, one embodiment in accordance with the invention.

BRIEF DESCRIPTION OF THE DRAWINGS

FIG. 1 is a fragmentary plan view of a can end with a pull tab according to the prior art;

FIG. 2 is an enlarged fragmentary vertical sectional view taken along the line 2—2 of FIG. 1;

FIG. 3 is a view similar to FIG. 2 showing the prior art can end as the pull tab is being pulled upwardly and rearwardly;

FIG. 4 is a fragmentary plan view of a can end with a pull tab according to a preferred embodiment of the present invention;

DETAILED DESCRIPTION OF THE DISCLOSED EMBODIMENT

Figure 5:
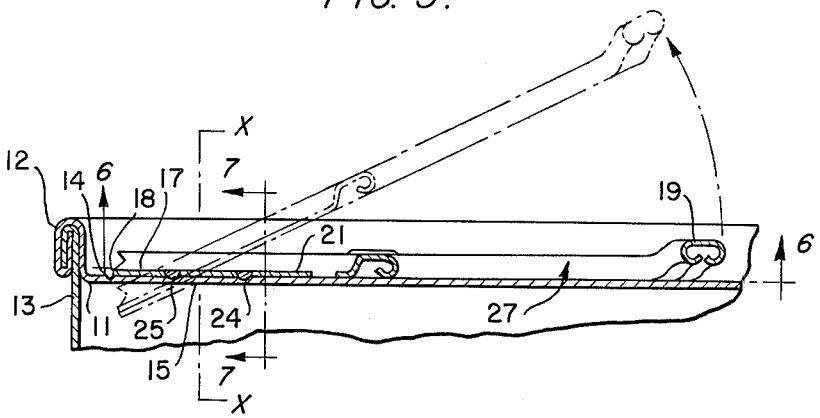
FIG. 5 is an enlarged fragmentary vertical sectional view taken along the line 4—4 of FIG. 4.

Referring now to the drawings, particularly FIGS. 4–10, it will be seen that there is illustrated an easy-open container wall in the form of a container end closure 10. The end closure 10 comprises a sheet material container wall panel 11 which is secured by means of a double seam 12 to a cylindrical container body 13. The wall panel 11 of the end closure 10 may be formed of steel, aluminum, plastic, laminates thereof or other suitable material as discussed more fully below. The wall panel 11 includes a line of weakness in the form of a score line 14 which defines a removable panel 15.

Figure 6:
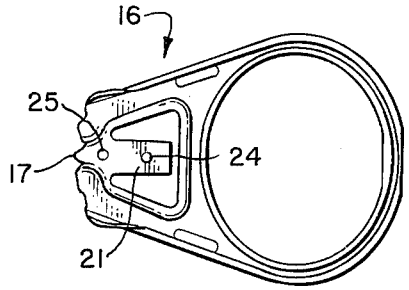
FIG. 6 is an enlarged horizontal sectional view taken along the line 6—6 of FIG. 5.
Figure 7:
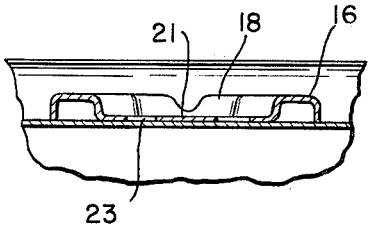
FIG. 7 is an enlarged fragmentary transverse vertical sectional view taken along the line 7—7 of FIG. 5.

In order to facilitate the rupture of the wall panel 11 at the scoreline 14 and the tearing out of the removable panel portion 15, there is provided a pull tab which is generally referred to by the numeral 16. The pull tab 16 is preferably formed of the same or similar sheet material as the wall panel 11. It is generally flat with curled edges for reinforcement and includes a chisel point 17 at its working or nose end 18, a lifting end 19 in the form of a finger ring 20 which is rigidly connected to the nose end 18, and a hingedly mounted attaching panel 21 located intermediate the ends 18 and 19 and extending away from the nose end 18 for permitting hinged movement of a majority of the tab relative to the attaching panel 21 along a hinge line X—X extending transversely of the longitudinal direction of the tab between the end portions 22 of a concavely shaped cut 23 defining the attaching panel 21. The sheet material of the tab along and adjacent the attaching panel 21 is sufficiently pliable to hingedly attach the attaching panel to the remainder of the tab so as to form the hinge line X—X. The concavely shaped cut or opening 23 opens toward the nose end 18 of the tab as depicted in FIGS. 4 and 6 of the drawings.

The tab 16 is attached to the removable panel portion 15 of the wall panel 11 on both sides of the hinge line X—X. More specifically, in the illustrated embodiment the hingedly mounted attaching panel 21 of the tab 16 is connected to the removable panel portion 15 of the wall panel 11 on the side of the hinge line X—X away from the nose end 18 of the tab by a weldment 24 and the tab is also connected to the removable panel portion 15 on the side of the hinge line X—X toward the nose end 18 by a weldment 25.

Attaching the tab 16 to the removable panel portion 15 at locations at both sides of the hinge line X—X offers the advantages of maintaining the alignment of the tab 16 on the end closure 10 so that the nose end 18 remains positioned adjacent the score line 14 as compared with the prior art rivet connection wherein the tab may rotate about the rivet connection and skew or misalign the position of the tab on the end closure, and at the same time the invention offers the additional significant advantage that during opening, pulling of the tab material around its connection with the removable panel portion to break the connection of the tab therewith is avoided.

Figure 8:
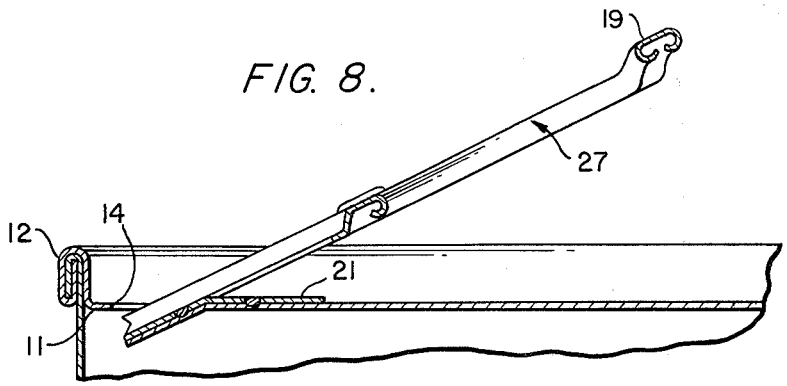
FIG. 8 is an enlarged fragmentary vertical sectional view similar to FIG. 5 showing the tab in a position where the lifting end thereof has been lifted to rupture the line of weakness in the can end and bend a segment of the removable panel of the can end inwardly.
Figure 9:
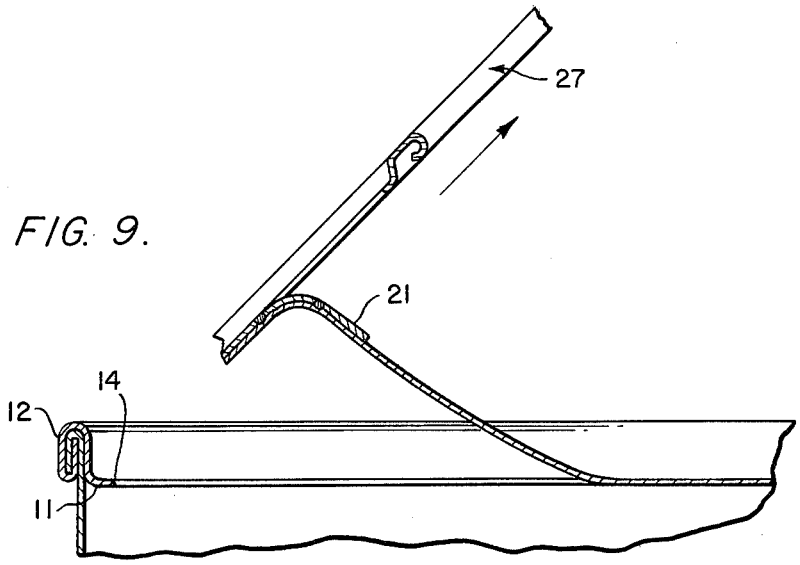
FIG. 9 is an enlarged fragmentary vertical sectional view similar to FIG. 8 showing the tab in a position where the lifting end thereof has been lifted as shown in FIG. 7 and thereafter pulled in the direction of arrow A to progressively tear a portion of the removable panel from the can end.
Figure 10:
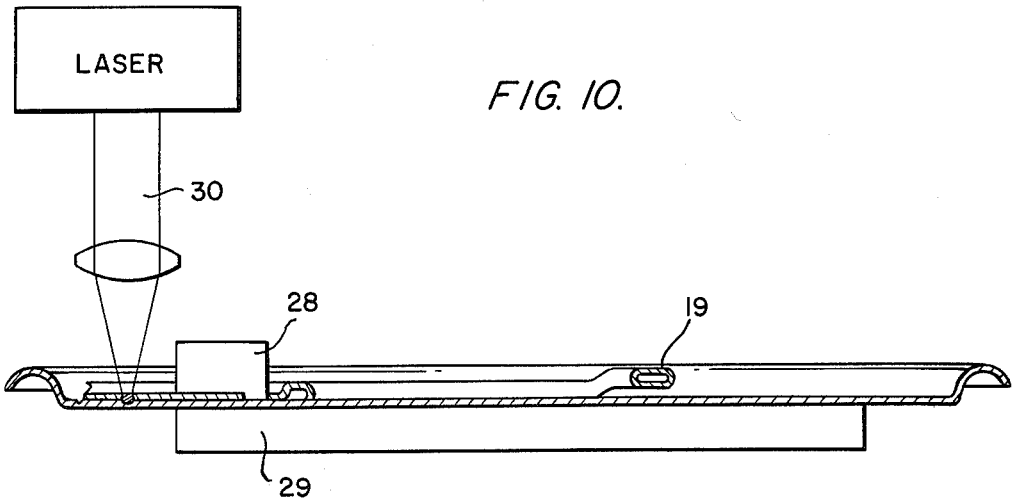
FIG. 10 is an enlarged vertical sectional view similar to FIG. 5 showing the pull tab and container wall panel in clamped position for welding.

Referring now to FIGS. 5, 8 and 9 in particular, it will be seen that when it is desired to open the end closure 10 of the container body 13, the rear or lifting end 19 of the finger ring 20 is lifted. As the tab 16 is lifted, it will hinge about the transverse line X—X extending between the end portions of the concavely shaped cut or opening 23 with the majority of the pull tab 16 hinging relative to the attaching panel 21. During the initial portion of the lifting movement of the tab 16, there will be a certain amount of slack which will permit the elevation of the lifting end 19 of the finger ring 20 a sufficient distance to facilitate the firm engagement of one's finger in the finger receiving opening 27 thereof. After the tab 16 has been elevated to a position where it may be readily gripped, the nose end 18 comes into forceable engagement with the removable panel portion 15 along the scoreline 14 and further upward movement of the finger ring 20, through the simple lever effect of the pull tab, results in the exertion of a downward pressure on the removable panel portion 15 immediately adjacent the scoreline 14 of a magnitude to effect the rupture of the container wall panel 11. After the initial rupture occurs, the entire removable panel portion 15 may be torn out by an upwardly and rearwardly directed pull on the pull tab 16 as in the direction of arrow A in FIG. 9.

When the pull tab 16 is lifted to the position shown in FIG. 8 the weldment 25 closest to the nose end 18 of the pull tab is in compression as a segment of the removable panel portion 15 is bent inwardly. The weldment 24 on the opposite side of the hinge line X—X from weldment 25 experiences shear stress during this lifting as it resists the forward component of the lifting force to effect the lever action about the hinge line X—X. When the pull tab 16 is pulled in the direction of arrow A in FIG. 9 to progressively tear the removable panel portion 15 from the wall panel 11, the weldment 25 experiences essentially shear stress and prevents the material of the pull tab 16 from being pulled and broken around its connection to the removable panel portion 16 at weldment 24.

The weldments 24 and 25 are preferably formed by means of a high energy density welding process wherein the energy density is at least on the order of $10^6$ watts/inch$^2$such as with laser welding. Laser welding may be performed by welding with a 400 watt NdYAG laser. A 2KW gas laser may also be used wherein, for example, welding can be accomplished using a 500 watt laser beam focused to a diameter of 0.004 inch. The pull tab 16 and wall panel 11 are maintained in contact during welding by suitable clamps illustrated schematically at 28 and 29 in FIG. 9, as the laser beam 30 and clamped components are moved relative to one another to effect welding on both sides of the hinge line X—X. Alternatively, the connections between the tab and wall panel could be made by another high energy density welding process such as electron beam welding or by other techniques, for example, by gluing, riveting or otherwise laminating the components together.

If rivets are used to connect the pull tab to the wall panel, it is normally necessary for the sheet material of the wall panel to be relatively ductile to permit formation of a rivet head therefrom. The wall panel can be formed of a ductile aluminum sheet material, for example, in such a case. A steel sheet material could also be used for the wall panel if the material has a relatively low temper and low tensile strength, that is, a tensile strength of less than approximately 60,000 psi and a temper of from T1 to T4. One such material is a low carbon steel, either plain or plated, having a thickness of 0.012 inch. The continuously annealed, tempered material (T4) may be formed from 109 lb. plate material. However, when a high energy density welding process is used to join the pull tab to the wall panel as in the disclosed embodiment, it is possible to use not only a relatively ductile aluminum or steel sheet material for the wall panel, but also a higher tensile strength, less ductile sheet material such as a high tensile strength double reduced low carbon steel. This is advantageous because a higher tensile strength material enables a thinner sheet material to be used for the wall panel. For example, with the present invention the sheet material wall panel can be formed from an 85 lb. double reduced, continuously annealed steel material having a thickness of 0.0094 inch or less. Therefore, a significant cost savings in the manufacture of ends for containers can be achieved. The laser weldments 24 and 25 may also be relatively small as compared with the size of the rivet heads so that a further savings of material is possible in reducing the size of the attaching panel of the pull tab.

While I have shown and described one embodiment in accordance with the present invention, it is understood that the same is not limited thereto but is susceptible of numerous changes and modifications as would be known to those skilled in the art, given the present disclosure. For example, instead of a container end closure having a removable panel portion which is essentially a full panel extending over most of the surface of the end closure as in the disclosed embodiment, the present invention is applicable to a container wall wherein only a relatively small portion of the wall panel is removed so as to define a drink or pouring opening. Further, the removable panel portion need not be completely removed from the end closure after opening but could remain attached to the end closure at one side or end in a manner readily apparent to the skilled artisan. I therefore do not wish to be limited to the details shown and described herein but intend to cover all such changes and modifications as are encompassed by the scope of the appended claims.

I claim:

1. An easy-open container wall comprising a line of weakness in said container wall defining a tear portion at least partially removable from said container wall, a tab having a line of weakness severing nose end and a lifting end and having hinge means for permitting hinged movement of one portion of said tab relative to another portion of said tab along a hinge line to bring said nose end into forceable engagement with said container wall to rupture said line of weakness and bend a segment of the tear portion inwardly upon lifting said lifting end of the tab, and attachment means for attaching said tab to said tear portion at locations on both sides of said hinge line.

2. An easy-open container wall according to claim 1, wherein said attachment means includes at least one weld connecting the tab to the tear portion at locations on both sides of the hinge line.

3. An easy-open container wall comprising a line of weakness in said container wall defining a tear portion at least partially removable from said container wall, a tab having a line of weakness severing nose end, a lifting end, and a hingedly mounted attaching panel located intermediate said ends for permitting hinged movement of a majority of said tab relative to said attaching panel along a hinge line to bring said nose end into forceable engagement with said container wall to rupture said line of weakness and bend a segment of the tear portion inwardly upon lifting said lifting end of the tab, and attachment means for attaching said tab to said tear portion at locations on both sides of said hinge line.

4. An easy-open container wall according to claim 3, wherein said attaching panel is an integral part of said tab and is defined by a concavely shaped cut opening towards said nose end of said tab.

5. An easy-open container wall according to claim 3, wherein said attaching panel extends away from said nose end.

6. An easy-open container wall comprising a line of weakness in said container wall defining a tear portion at least partially removable from said container wall, a tab having a line of weakness severing nose end, a lifting end rigidly connected to said nose end, and a hingedly mounted attaching panel located intermediate said ends and extending away from said nose end for permitting hinged movement of a majority of said tab relative to said attaching panel along a hinge line extending generally transverse to the longitudinal direction of said tab to bring said nose end into forceable engagement with said wall to rupture said line of weakness and bend a segment of the tear portion inwardly upon lifting said lifting end of the tab, and attachment means for attaching the attaching panel of said tab to said tear portion on the side of said hinge line away from the nose end of said tab and for attaching said tab to said tear portion on the side of said hinge line toward said nose end.

7. An easy-open container according to claim 6, wherein said attachment means includes at least one weld located on each side of said hinge line.

8. A method of forming an easy-open container wall comprising the steps of providing a line of weakness in said container wall defining a tear portion at least partially removable from said container wall, providing a tab having a line of weakness severing nose end, a lifting end and hinge means for permitting hinged movement of one portion of said tab relative to another portion of said tab along a hinged line to bring said nose end into forceable engagement with said container wall to rupture said line of weakness and bend the segment of the tear portion inwardly upon lifting said lifting end of the tab, and attaching said tab to said tear portion at both sides of said hinge line.

9. A method according to claim 8, wherein said attaching step comprises connecting said tab to said tear portion by welding said tab to said tear portion on each side of said hinge line.

10. A method according to claim 9, wherein said welding is accomplished by laser welding.

* * * * *